United States Patent [19]

Nicholl

[11] 4,288,942

[45] Sep. 15, 1981

[54] AERODYNAMIC DEVICE

[76] Inventor: Thomas H. Nicholl, 1204 W. 27th, Kansas City, Mo. 64108

[21] Appl. No.: 63,365

[22] Filed: Aug. 3, 1979

[51] Int. Cl.[3] ..... A63H 27/00

[52] U.S. Cl. ..... 46/74 D; 273/424

[58] Field of Search ..... 46/74 D, 75, 74 R, 228; 273/424, 425; 244/12.2, 23 C

[56] References Cited

U.S. PATENT DOCUMENTS

| | | | |
|---|---|---|---|
| 2,822,176 | 2/1958 | Robes | 273/424 |
| 2,835,073 | 5/1958 | Dame | 46/74 D X |
| 3,107,071 | 10/1963 | Wessels | 244/23 C |
| 3,359,678 | 12/1967 | Headrick | 46/74 D |
| 3,580,580 | 5/1971 | Wark | 273/425 |
| 3,613,295 | 10/1971 | Everett | 273/424 X |
| 3,765,122 | 10/1973 | English | 46/74 D |
| 3,828,466 | 8/1974 | Geiger | 46/74 D |
| 3,939,602 | 2/1976 | Burke et al. | 46/74 D |
| 4,045,029 | 8/1977 | Katzmark | 273/425 |
| 4,132,031 | 1/1979 | Psyras | 46/228 |
| 4,216,611 | 8/1980 | Psyras | 46/74 D |

FOREIGN PATENT DOCUMENTS

| | | | |
|---|---|---|---|
| 1918150 | 10/1970 | Fed. Rep. of Germany | 46/74 D |
| 788852 | 1/1958 | United Kingdom | 244/23 C |

*Primary Examiner*—Gene Mancene
*Assistant Examiner*—Mickey Yu
*Attorney, Agent, or Firm*—Fishburn, Gold and Litman

[57] ABSTRACT

An aerodynamic device having a concave-convex disk member with a rim and a substantially flat portion terminating in a downwardly curved portion adjacent the rim forming an upper convex surface with vanes on the disk to effect outward air flow in response to rotation of the device. A device with the disk having an air opening in the flat portion and a second disk member within the first disk member with the periphery of the second disk member adjacent and spaced from the rim with an air discharge aperture therebetween, said disk members having ribs therebetween for effecting air flow outwardly in response to rotation thereof for providing increased lift to the device.

6 Claims, 9 Drawing Figures

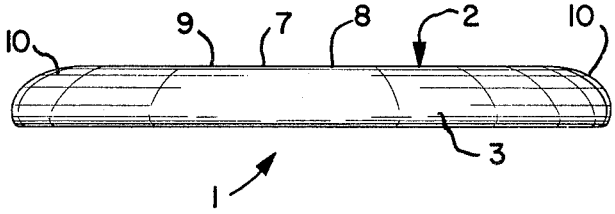
Fig. 1.
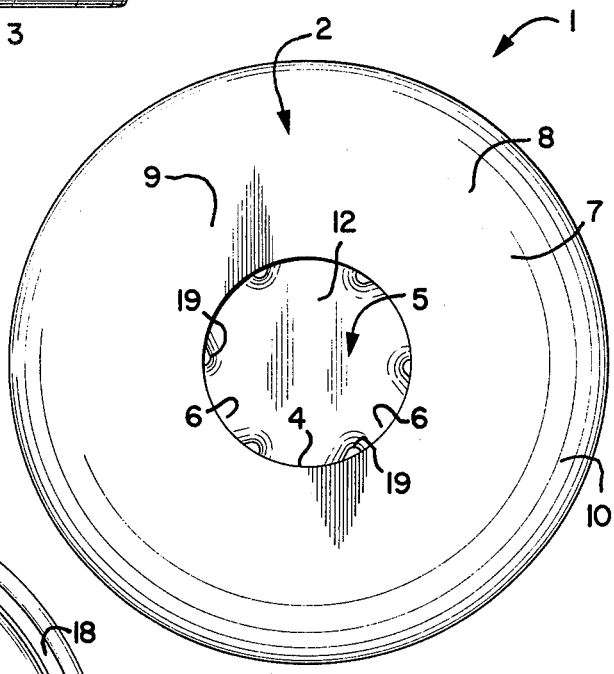
Fig. 2.
Fig. 3.
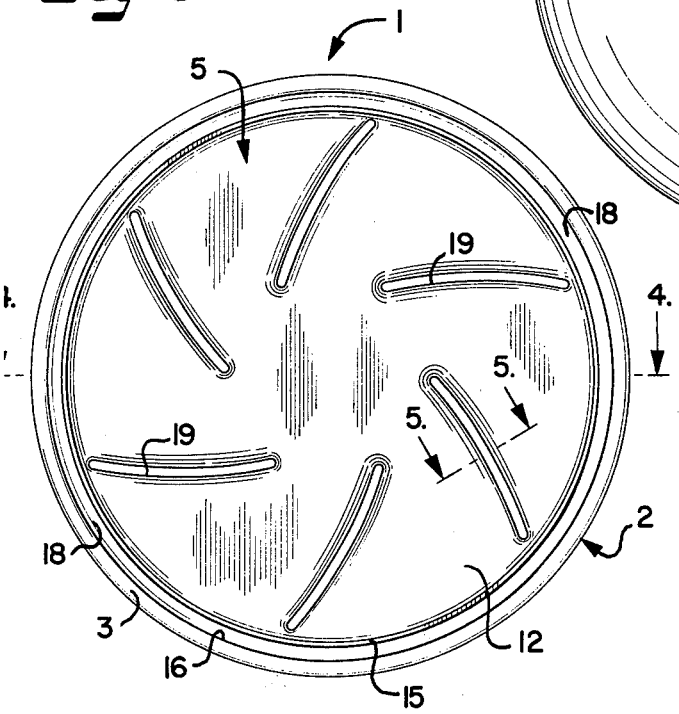
Fig. 5.
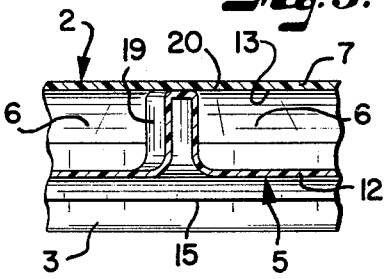
Fig. 4.
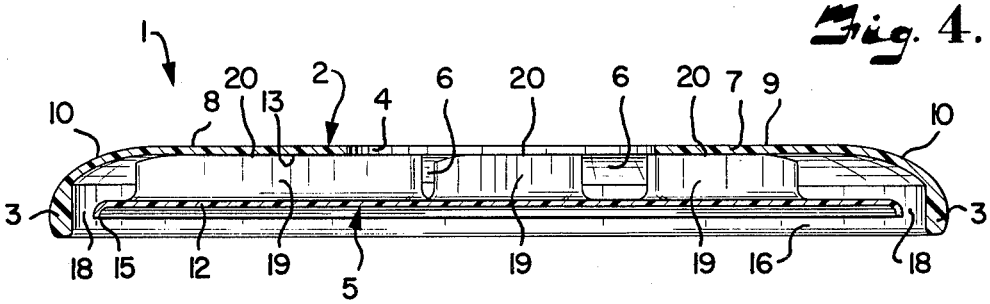

AERODYNAMIC DEVICE

This invention relates to aerodynamic devices or objects to be thrown or sailed through the air and more particularly to an aerodynamic device having surfaces and portions for air movement providing a lift thereto.

The principal objects of the invention are to provide an aerodynamic device having surfaces for air movement in response to passage through the air with a whirling motion to give a lifting action thereto; to provide such a device with a plurality of circumferentially spaced upstanding vanes extending outwardly to move air and provide a lift in response to rotation of the disk member; to provide such a device having a circular convex-concave member with a structure within the concave portion for movement of air from from above the center of said member and discharge of same downwardly adjacent the periphery when moving through the air; to provide such a device that is thrown with a whirling motion that has a central opening in said member and wherein said air moving structure is a wall spaced from the circular convex member with an annular slot between said wall and rim of said member for downward discharge of the air; to provide such a device with a plurality of spaced vanes in the space between the annular convex member and wall extending from said opening to the wall periphery for facilitating air movement in said space; to provide such a device that utilizes flow of air over outer convex surfaces and movement of air through internal passages with downward discharge for improved stability, lift and hovering characteristics; to provide such an aerodynamic device that is economical to manufacture in an efficient, durable display device, toy and the like.

Other objects and advantages of this invention will become apparent from the following description taken in connection with the accompanying drawings wherein are set forth by way of illustration and example, certain embodiments of this invention.

The drawings constitute a part of the specification and include an exemplary embodiment of the present invention and illustrate various objects and features of the device.

FIG. 1 is a side elevational view of the device embodying the present invention.

FIG. 2 is a top view of the device.

FIG. 3 is a bottom view of the device.

FIG. 4 is an enlarged sectional view taken through the device on the line 4—4, of FIG. 2.

FIG. 5 is a further enlarged sectional view through the device taken on the line 5—5, of FIG. 3 and particularly showing a vane.

Figure 6:
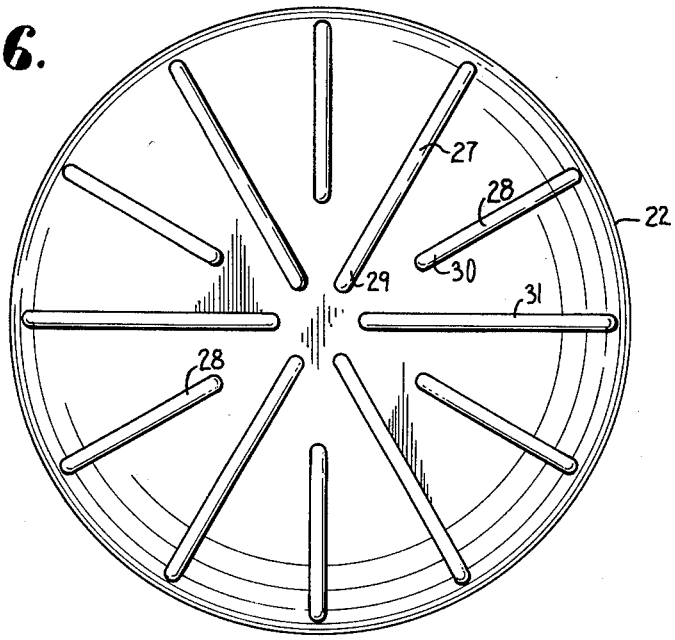
FIG. 6 is a top view of a modified form of aerodynamic device.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates an aerodynamic device for movement through the air and having a convex-concave body member 2 with a peripheral rim 3 and a central opening 4. The device has a structure 5 within the body member 2 and cooperating therewith to define air passages 6 for movement of air from above the body member 2 through the opening 4 and through the air passages 6 for discharge downwardly adjacent the rim 3 particularly in response to whirling or rotary motion of the device while sailing or moving through the air.

In the illustrated structure the device 1 is in a form suitable to be thrown or otherwise projected into the air with a whirling motion for flight. The convex-concave member 22 is generally circular, resembling an inverted saucer, and has a wall 7 with a top surface 8 with a smooth transition from a flat central portion 9 to the rim 3 provided by a curved portion 10. The central portion 9, curved portion 10 and rim 3 define the outer surfaces 8 that form the convex side of the member 2. The central opening 4 is illustrated as being formed in the flat portion 9, axially of the body member 2 and as being sized for unobstructed movement of any air to be discharged downwardly as later described.

The curved convex portion 10 of the body member 2 resembles a air foil with the rim 3 at the lower portion thereof being of greater thickness than the wall 7 to provide additional mass and increased inertia when whirling to maintain angular momentum. It is preferred that the member be made of a light weight material such as an impact resistant synthetic resin for ease of throwing and resistance to damage when landing. The body member 2 is particularly adapted for manufacture by a conventional one step molding operation.

The one piece body member 2 could be used alone for throwing and the air foil shape would provide some lift. However, the lift of the device 1 is increased by the cooperative action of the body member 2 and the structure 5 in response to whirling or rotation of the device. The structure 5 is arranged and connected to the body member 2 to draw air from above the body member 2 through the opening 4 therein adjacent the axial center thereof, moving the air inside the device to adjacent the rim or periphery 3, and discharging same downwardly through suitable apertures providing further lift and stability in flight.

In the device illustrated, the structure 5 includes a disk or wall member 12 that is suitably secured to the body member 2 and cooperates with the inner surface 13 of the wall 7 to define the air passages 6 therebetween. While the wall member 12 is shown as a thin flat wall with a peripheral edge 15 spaced from the inner surface 16 of the rim 3 to provide the discharge aperture 18 therebetween the outer portions of the wall maybe inclined toward the portions 9 and 10 of the body member 2 to progressively reduce the space therebetween toward the peripheral edge 15 and thereby increase the velocity of air moved therebetween. The peripheral edge 15 is preferably curved downwardly to facilitate movement of air from the passages 6 to the aperture 18. The wall member 12 is shown as substantially impervious and is arranged relative to the inner surface 13 of the wall 7 whereby the space therebetween progressively decreases from adjacent the opening 4 to the discharge aperture 18.

It is found that the rotation of the device will cause air to move from the opening 4 and outwardly through the passages 6 to the discharge aperture 18. The structure illustrated provides for increasing or facilitating the flow by an arrangement of vanes 19 in the space between the wall member 12 and the wall 7 in circumferentially spaced relation with each of the vanes 19 extending outwardly from the periphery of the opening 4 substantially to the periphery of the wall member 12. It is preferred that the vanes 19 be curved and engage the wall member 12 and the wall 7 to cooperate therewith and define individual passages 6 therebetween whereby the vanes 19 and wall members 12 and 7 cooperate and act in the manner of a centrifical pump to provide positive movement of the air outwardly through the passages 6 for discharge downwardly through the apeyture 18.

In the structure illustrated the vanes 19 are integral with and deformed from the wall member 12 as by vacuum forming with the vanes 19 having closed ends so that all air moving between the walls 7 and 12 pass to the discharge aperture 18. The structure 5 may be secured to the body member 2 in any suitable manner, as for example, the vanes 19 are welded along the apex 20 thereof to the underside surface 13 of the wall 7. It is preferred that the weld extend along the length of the vanes 19, however a plurality of spaced welds may be used to securely fasten the structure 5 to the member 2.

In using a device constructed as described, as a throwing implement, display, or toy, a user grips the device at one side with a thumb on the convex surface and one or more of the fingers engaging the wall 12. The device is then thrown by the user swinging his arm and snapping his wrist to throw the device into the air with a spinning motion. As the device moves through the air, the air passing over the spinning curved portion 10 provides an aerodynamic lift. Also, as the device spins, the impeller action of the vanes 19 draw air from above the body member 2 through the opening 4 and moves said air through the passages 6 and discharges same downwardly through the aperture 18 which is in the form of a narrow annular slot, whereby the air has increased velocity to provide lift to the device. In the action, the removal of the air from above the disk member causes increased lift and the discharge of said air through the narrow discharge aperture 18 further adds lift and since the discharge is around the entire outer periphery there is increased stability, all resulting in greater duration of flight and distance as well as stability during the flight.

Figure 7:
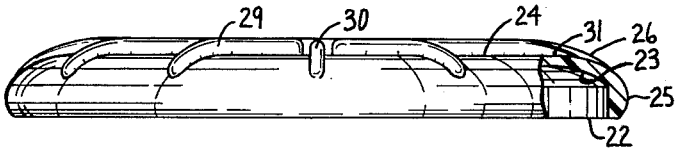
FIG. 7 is a side elevation of the aerodynamic device of FIG. 6 with portions broken away to show the rim shape.

The aerodynamic device illustrated in FIGS. 6 and 7 has a convex-concave member 22 that has a wall 23 with a top surface 24 having a smooth transition from a flat central portion to the rim 25 provided by a curved portion 26. The central portion, curved portion 26 and rim 25 define the outer surfaces 24 that form the convex side of the member 22. The convex side of the member 22 resembles an airfoil with the rim 25 at the lower portion thereof being of greater thickness than the wall 23 to provide additional mass and increased inertia when twirling to maintain angular momentum. In the form of the aerodynamic device 22 illustrated in FIGS. 6 and 7 a plurality of radial ribs or vanes 27 and 28 are upstanding on the convex side of the body member with each of the ribs extending radially in circumferentially spaced relation and the ribs 27 alternating with the ribs 28. The inner ends 29 of the ribs or vanes 27 are near the axial center of the device with sufficient spaceing whereby the inner ends of the ribs 27 have a spacing similar to the radial spacing of the inner ends from the axis. The inner ends 30 of the ribs or vanes 28 have a greater spacing from the axis as illustrated in FIG. 7, with the spacing between the inner ends of opposed ribs or vanes 28 being in the nature of $\frac{1}{3}$ the diameter of the device 22. The outer ends 31 of all of the ribs curve downwardly to merge into the curvature 26 of the body member 22.

In using a device constructed as described and illustrated in FIGS. 6 and 7, the user grips the device at one side and throws same into the air with a spinning motion and as the device moves through the air the impeller action of the ribs or vanes 27 and 28 draws air from above the member 22 and moves same to the periphery, discharging the air outwardly to provide an increased lift, cooperating with the air passing over the spinning curved portion 26 to provide increased aerodynamic lift of the device.

Figure 8:
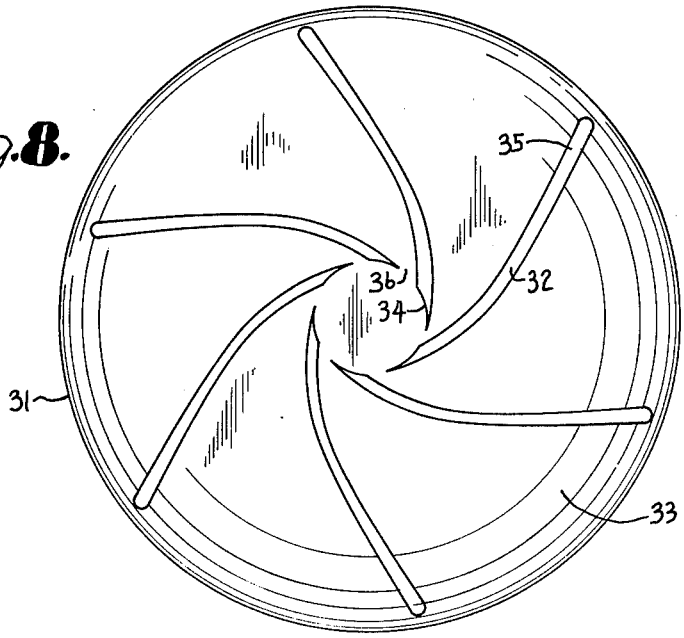
FIG. 8 is a top view of a further modified form of aerodynamic device.
Figure 9:
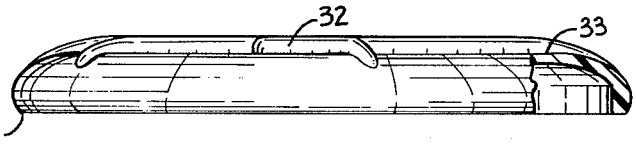
FIG. 9 is a side elevation of the aerodynamic device of FIG. 8 with portions broken away to show the rim shape.

In the modified form shown in FIGS. 8 and 9 the body member 31 is substantially the same construction as the body member 22 illustrated in FIGS. 6 and 7 except that the ribs or vanes 32 extending upwardly from the convex surface 33 are circumferentially spaced in defined spirals from inner ends 34 to outer ends 35. The inner ends 34 are spaced from the axial center sufficiently whereby the inner ends 34 are also circumferentially spaced as at 36 to permit air to enter and pass between the inner ends of the adjacent ribs or vanes. The ribs or vanes 32 all spiral in a manner whereby when the device is spinning clockwise, when viewed from the top as in FIG. 8, the spiral is rearwardly so that the outer ends 35 are in trailing relation to the direction of rotation of the aerodynamic device.

In using an aerodynamic device as illustrated in FIGS. 8 and 9, the device is grasped and thrown with a spinning motion in the same manner as the device shown in FIGS. 6 and 7 and the ribs cause the air above the convex surface to be impelled outwardly and discharged over the periphery of the body member so as to provide increased lift of the aerodynamic device.

It is to be understood that while I have illustrated and described certain forms of my invention, it is not to be limited to the specific forms or arrangement of parts herein described and shown.

What I claim and desire to secure by Letters Patent is:

1. An aerodynamic device adapted to provide an upwardly resulting force thereon through rotation of the device about a longitudinal axis thereof comprising:

(a) a first disk member having a central portion and a substantially flat circular surface area whose outer boundary is defined by a predetermined radius, said central portion having an air inlet opening therethrough;

(b) said first disk member having a rim circumscribing said flat circular surface area;

(c) a surface of curvature extending from said boundary and curving downwardly to the point of juncture with said rim to form an upper convex surface and a lower concave surface of the first disk member;

(d) a second impervious disk member spaced apart by means from said first member concave surface such that an outer periphery thereof is spaced radially inwardly of said rim defining an annular discharge aperture therebetween;

(e) spacer means comprising a plurality of radially spaced impeller vanes positioned between said first disk member concave surface and said second disk member and substantially extending outwardly from said air inlet opening to said discharge aperture; said vanes defining therebetween a plurality of air passages from said air inlet opening to said air discharge aperture such that upon rotation of said device air between said first disk member and said second disk member is urged outwardly by said vanes and discharged downwardly through said air discharge aperture thereby producing a resultant upward force on said device.

2. An aerodynamic device as set forth in claim 1 wherein:

(a) said opening in said first disk member is centrally of said flat circular surface and of total area as great as the total area of said discharge aperture; and (b) said vanes are generally radial and curved in the form of impeller vanes to provide a lift by drawing air into said opening and further lift by discharge of air downwardly through said discharge aperture in response to rotation of the device.

3. A device as set forth in claim 1 wherein:

(a) said vanes are curved.

4. An aerodynamic device for throwing into the air with a whirling action and rotating said device about a longitudinal axis thereof comprising:

(a) a generally circular first member molded of a synthetic resin and having a thickness to form a first wall, said member shaped to define a generally flat upper portion with a circular central opening therethrough, an annular peripheral rim substantially perpendicular to the plane of said flat upper portion, and a curved portion extending from said flat portion to said rim providing a generally convex outer surface and a concave inner surface on said member with the outer surface of the curved portion serving as an airfoil;

(b) said rim being of a thickness greater than said first wall for increased peripheral mass and rotative inertia;

(c) a second impervious wall member of synthetic resin below and spaced from said inner surface and having an outer periphery thereof spaced inwardly of said rim and cooperating therewith to define a narrow annular downwardly oriented discharge aperture therebetween;

(d) a plurality of circumferentially spaced vanes extending radially substantially from said first member opening to said annular discharge aperture in the space between said inner surface and second wall member and engaged therewith to define a plurality of mutually exclusive air passages from said first member opening to said air discharge aperture; and (e) said first and second members being secured together with said vanes being responsive to rotation of said device to draw air from above said opening, to urge same through said passages and discharge same downwardly through said discharge aperture thereby generating additional lift as said device is spun through the air.

5. An aerodynamic device as set forth in claim 4 wherein:

(a) said second wall member is a relatively flat, thin, light weight impervious member and the space between said second wall member and the first wall member progressively diminishes between said opening and the discharge aperture.

6. An aerodynamic device as set forth in claim 5 wherein:

(a) said vanes are integral with said second wall member and are thin walled for lightness in weight;

(b) said vanes are curved outwardly from the periphery of said opening; and (c) the first and second wall members are secured together along the engagement of the vanes with said first wall member.

* * * * *